US008308140B2

(12) United States Patent
Boukal et al.

(10) Patent No.: US 8,308,140 B2
(45) Date of Patent: Nov. 13, 2012

(54) TERMINATOR BRACKET ASSEMBLY

(75) Inventors: Josef A. Boukal, Madison, AL (US); Bryan F. Magee, Killen, AL (US); David M. Malone, Tuscumbia, AL (US); Susan R. Kavanaugh, Florence, AL (US); Harry Raney, Florence, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 559 days.

(21) Appl. No.: 12/614,688

(22) Filed: Nov. 9, 2009

(65) Prior Publication Data

US 2011/0108789 A1 May 12, 2011

(51) Int. Cl.
*A01K 3/00* (2006.01)

(52) U.S. Cl. ..... 256/10; 256/45; 24/265 C

(58) Field of Classification Search ..... 256/10, 256/42, 45; 24/265 C
See application file for complete search history.

(56) References Cited

U.S. PATENT DOCUMENTS

| | | | | |
|---|---|---|---|---|
| 597,583 | A | 1/1898 | Kopka | |
| 1,778,073 | A | 10/1930 | Gish | |
| 2,795,399 | A | 6/1957 | Anderson | 256/12.5 |
| 2,872,161 | A | 2/1959 | Olson | 256/24 |
| 3,206,816 | A * | 9/1965 | Vilcins et al. | 24/200 |
| 3,414,943 | A * | 12/1968 | Hattori | 24/200 |
| 3,967,347 | A * | 7/1976 | Bickis, Sr. | 24/200 |
| 4,117,573 | A * | 10/1978 | Nakamura | 24/22 |
| D252,132 | S * | 6/1979 | Fujishiro | D8/383 |
| 4,400,855 | A * | 8/1983 | Stuart | 24/200 |
| 4,932,634 | A | 6/1990 | Sura | 256/12.5 |
| 5,426,829 | A * | 6/1995 | Hsiung | 24/197 |
| 5,600,875 | A * | 2/1997 | Chang | 24/200 |
| D389,779 | S * | 1/1998 | Poynter | D11/218 |
| 6,325,347 | B1 | 12/2001 | Crichton | 248/228.1 |
| 6,502,322 | B2 * | 1/2003 | Smochek | 33/373 |
| 6,648,305 | B2 * | 11/2003 | House et al. | 256/37 |
| 6,834,846 | B2 * | 12/2004 | Robbins, III | 256/32 |
| 6,848,678 | B2 * | 2/2005 | Reiff | 256/32 |
| 7,475,869 | B2 * | 1/2009 | Dennis | 256/40 |
| 7,566,047 | B2 * | 7/2009 | Wall | 256/32 |
| 2001/0034945 | A1 * | 11/2001 | Smochek | 33/373 |
| 2003/0094602 | A1 * | 5/2003 | House et al. | 256/40 |
| 2009/0057639 | A1 * | 3/2009 | Robbins et al. | 256/65.01 |

FOREIGN PATENT DOCUMENTS

GB 2284229 A * 5/1995

* cited by examiner

*Primary Examiner* — Victor MacArthur
(74) *Attorney, Agent, or Firm* — Brinks Hofer Gilson & Lione

(57) ABSTRACT

A coupling for an end of polymer jacketed high tensile wire fencing formed by a plate having first and second edges, a slot passing through the plate perpendicular to the first and second edges, having upper and lower ends spaced from the edges, a fold in the fencing defining a bight joining a shorter portion to a longer portion of the fencing, the fold penetrating the slot, and a pin of a length greater than the distance between the upper and lower ends of the slot, the pin having an end inserted into the bight in the fold of the fencing to retain the fold of the fencing in the slot, the pin being vertically removable from the bight to quickly release the fencing from the coupling.

19 Claims, 8 Drawing Sheets

TERMINATOR BRACKET ASSEMBLY

BACKGROUND

Fences are commonly used to confine livestock, such as farm animals, steers, and thoroughbred race horses. Fences may vary greatly in both structure and materials used in their construction. Fence structures which were traditionally available include those made of wire, (barbed wire, chain link, etc.), and wood (picket, split rail, etc.).

The materials used to construct a particular fence are often selected on the basis of initial costs, upkeep cost, durability, strength, aesthetic characteristics and animal safety requirements. The most commonly used materials include metal and/or wood. While concrete and stone are readily available, the cost is often prohibitive.

The most commonly used fencing material for livestock has been barbed wire. This is due to the low cost of installation and maintenance that such material presents. However, barbed wire can cause painful and unsightly injury to valuable livestock. Also, such material is difficult for the animal to detect and, all too often, the animal is injured during contact with this unseen barrier. Other materials, such as web wire fencing and cyclone wire fencing suffer from similar limitations. In addition, they tend to be expensive to install and maintain and, over time, can also operate to injure livestock.

Wood fences, on the other hand, while expensive to install and maintain, generally do not operate to injure livestock. Wood fences also offer a more pleasing aesthetic appearance.

In order to solve the difficulties presented by commonly available wire and wood fences, a fencing system using high tensile wire jacketed by polymer or vinyl coating has been developed. This type of fencing is typified by that illustrated in FIG. 8 of U.S. Pat. No. 4,706,942, as well as in U.S. Pat. Nos. 4,465,263; 4,860,996 and 6,834,846. The text and figures of these patents are incorporated by reference as if set forth fully herein.

Another method and apparatus for forming a fence line system comprised of a plurality of fence post members that are disposed in an array so as to enclose or divide a given area of land is typified by that illustrated and described in U.S. Pat. No. 6,152,429. Alternative connectors that can be used to terminate or splice polymer jacketed high tensile wire fencing are disclosed in U.S. Pat. No. 7,566,047.

While the systems of polymer jacketed high tensile wire fencing presents a satisfactory solution to some of the above-mentioned problems, there is still a need for an improved coupling arrangement for use in a termination and/or splice system which is relatively inexpensive, durable, strong, safe for physical contact with livestock, and ultimately easy to install. Desirably such an improved coupling arrangement would also provide for a simple disassembly by way of a quick release.

SUMMARY OF THE INVENTION

The coupling arrangement can include a plate having first and second edges that are generally parallel to each other. A slot passes through the plate generally perpendicular to the first and second edges, the slot having upper and lower ends that are spaced from the first and second edges. A fold in the polymer jacketed high tensile wire fencing can be arranged to define a bight joining a shorter portion of the fencing to a longer portion of the fencing. The fold can be caused to penetrate the slot of the coupling. A pin can have a length greater than the distance between the upper and lower ends of the slot. The pin can have one end inserted into the bight in the fold of the fencing and another end situated to engage one of the first and second edges of the plate to retain the fold of the fencing in the slot.

In one embodiment the plate can include a third edge extending between the first and second edges generally parallel to the slot and a fourth edge opposite the third edge. The fourth edge can be parallel to the third edge. Each of the first and second edges can additionally include a tab extending outward in general alignment with the fourth edge of the plate, each tab including an opening to receive a fastener. The fasteners can couple the tabs of the plate to an adjacent fence post. Optionally, the fourth edge of the plate can be positioned so that the tabs straddle a second polymer jacketed high tensile wire fencing to secure the second fencing to an adjacent fence post.

In an alternative embodiment, the plate can include a third edge extending between the first and second edges generally parallel to the slot and a fourth edge opposite the third edge. The fourth edge can be parallel to the third edge. The plate can include a second slot parallel to the first slot to receive a fold of a second polymer jacketed high tensile wire fencing that can define a bight joining a shorter portion of the second fencing to a longer portion of the second fencing. The fold of the second fencing can penetrate the second slot of the coupling. A second pin can be provided. The second pin can have an end inserted into the bight in the fold of the second fencing. The second pin can have another end engaging one of the first and second edges of the plate to retain the fold of the second fencing in the second slot.

In yet another embodiment, the plate can include a third edge extending between the first and second edges generally parallel to the slot and a fourth edge opposite the third edge. The fourth edge can define a laterally projecting tongue. The tongue can include at least one opening to receive a fastener. The fastener can penetrate the tongue to secure the plate to a fence post. Optionally, the fastener can also penetrate a second tongue of a second plate to secure both plates to a fence post at a single location.

In any of the embodiments, each of the first and second edges of the plate can include a rearwardly projecting flange. An end of the pin can include a bend of sufficient size to extend over a rear edge of the rearwardly projecting flange of one of the first and second edges while the opposite end is engaged in a bight of a bend in the fencing penetrating a slot in the plate. A feature of any of the embodiments is the presence of a pin engaged in a bight of a bend in the fencing penetrating a slot in the plate. An advantage of this feature is that the pin can be vertically removed from the bight to quickly release the fencing from the slot.

These and other features and advantages will become more readily apparent from the following detailed description of the presently described embodiments illustrated in the accompanying drawings.

DESCRIPTION OF PREFERRED EMBODIMENTS

Figure 1:
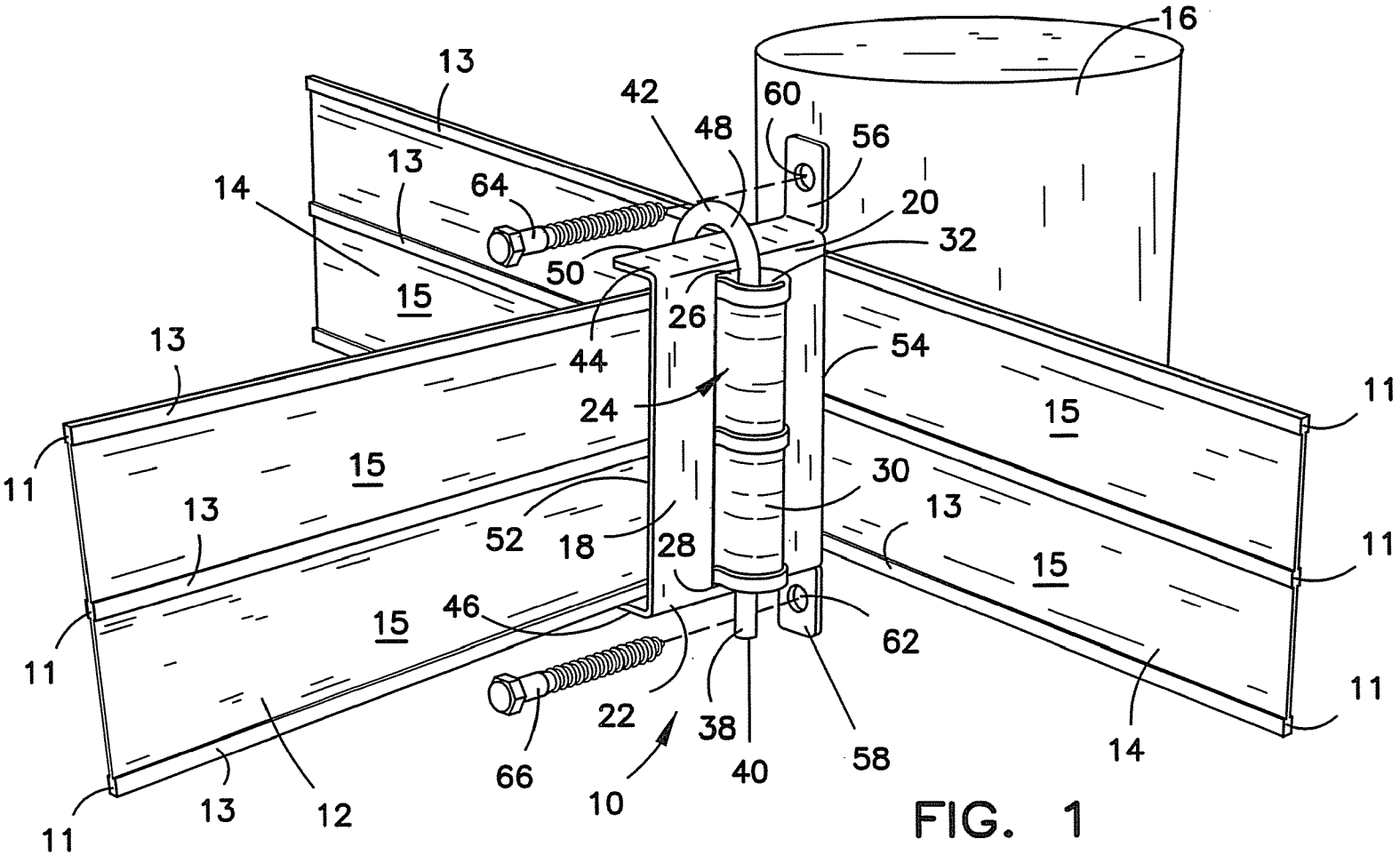
FIG. 1 is a perspective view of a first embodiment of the terminator bracket assembly coupled to an end of a first length of polymer jacketed high tensile wire fencing, with the bracket assembly straddling a second length of polymer jacketed high tensile wire fencing to secure both lengths of fencing to an adjacent fence post.
Figure 2:
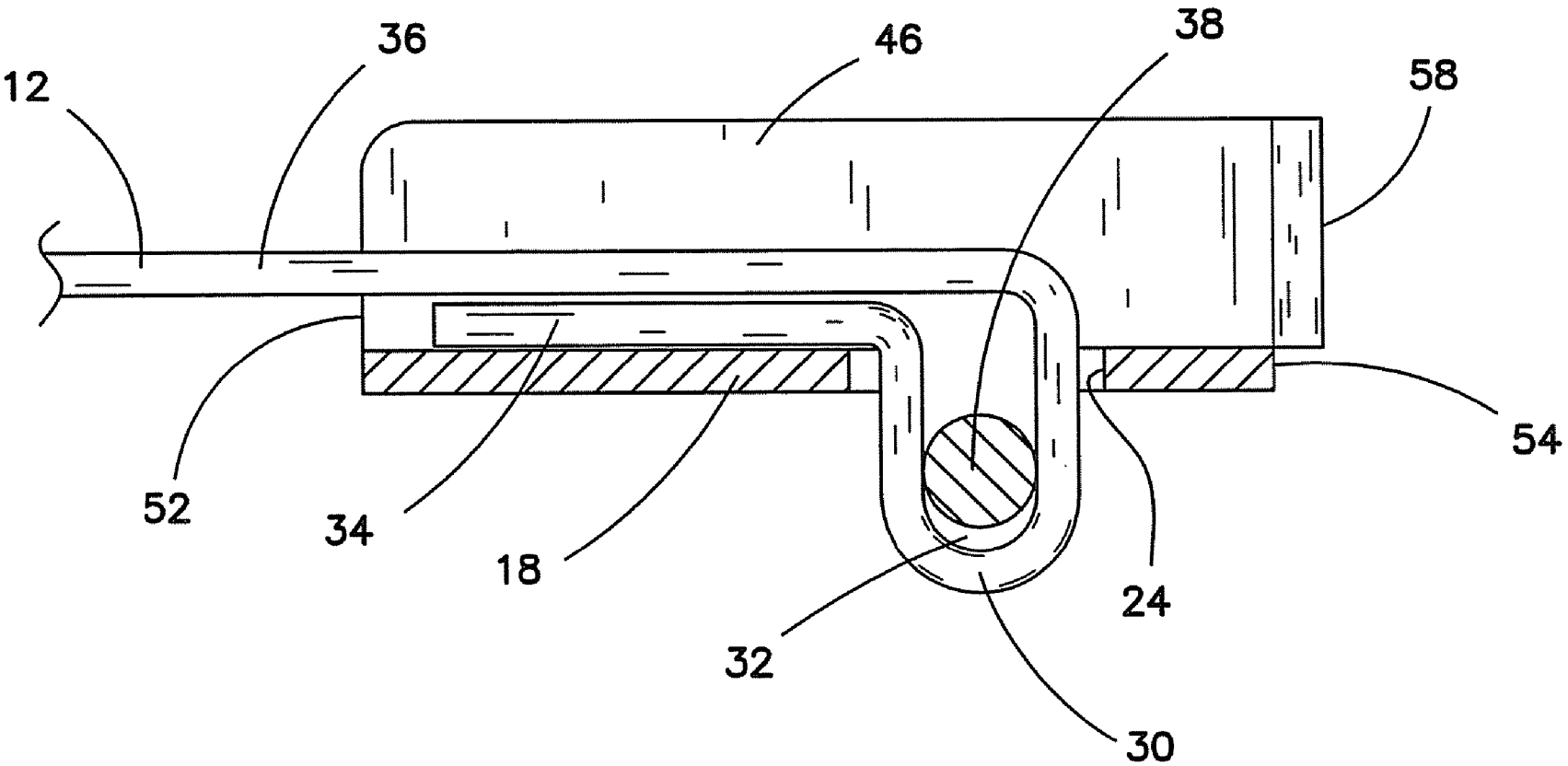
FIG. 2 is a sectional view of the bracket assembly shown in FIG. 1 showing the position of the shorter portion of the fencing within the bracket.

FIGS. 1 and 2 show a first embodiment of a terminator bracket assembly 10. FIG. 1 is a perspective view of the terminator bracket assembly 10, while FIG. 2 is a sectional view. The terminator bracket assembly 10 is shown to be coupled to an end of a first length of polymer jacketed high tensile wire fencing 12. In FIG. 1, the bracket assembly 10 is shown to be straddling a second length of polymer jacketed high tensile wire fencing 14 to secure both lengths of fencing 12, 14 to an adjacent fence post 16. The polymer jacketed high tensile wire fencing 12, 14 can have a variety of forms, but generally has at least two longitudinally extending high-tensile strength core members 11, typically formed of wire that may be electrically conductive. A solid polymeric sheath 13 encases each of the core members 11. A solid polymeric webbing 15 joins the sheaths 13 of adjacent core members 11 preferably at a fixed uniform separation distance in a substantially parallel arrangement. The first embodiment of the terminator bracket assembly 10 is shown in FIG. 1 to include a plate 18 having a first edge 20 and a second edge 22. The first and second edges 20, 22 are shown to be generally parallel to each other. A slot 24 passes through the plate 18 generally perpendicular to the first and second edges 20, 22. The slot 24 has an upper end 26 and a lower end 28 that are spaced from the first and second edges 20, 22, respectively. The first length of polymer jacketed high tensile wire fencing 12 includes a fold 30 that is arranged to define a bight 32 joining a shorter portion 34 of the fencing 12 to a longer portion 36 of the fencing 12. The fold 30 is shown to be positioned to penetrate the slot 24 of the plate 18. The shorter portion 34 of the fencing 12 is shown in FIG. 2 to lie against a surface of the plate 18.

A pin 38 has a lower end 40 and an upper end 42 separated from each other such that the pin 38 has a length which is greater than the distance between the upper end 26 and the lower end 28 of the slot 24. The pin 38 is shown to be inserted into the bight 32 in the fold 30 of the fencing 12. The upper end 42 of the pin 38 is shown to engage the first edge 20 of the plate 18 to retain the fold 30 of the fencing 12 in the slot 24. The first and second edges 20, 22 of the plate 18 are shown to include a rearwardly projecting flange 44, and 46, respectively. The upper end 42 of the pin 38 is shown to include a bend 48 of sufficient size to extend over a rear edge 50 of the rearwardly projecting flange 44 of the first edge 20 while the opposite end contacts the plate surface adjacent to the lower edge 22 and the pin 38 is engaged in the bight 32. The pin 38, and particularly the lower end 40 of the pin 38 is dimensioned such that the pin 38 can be removed vertically from the bight 32 to quickly release the fencing 12 from the slot 24.

The plate 18 is shown in FIGS. 1 and 2 to include a third edge 52 extending between the first and second edges 20, 22 generally parallel to the slot 24. A fourth edge 54 is located opposite the third edge 52. The fourth edge 54 is shown to be generally parallel to the third edge 52. Tabs 56 and 58 extend outward from the rearwardly projecting flanges 44 and 46, respectively, in general alignment with the fourth edge 54. Each of the tabs 56 and 58 include an opening 60 and 62, respectively. Fasteners 64 and 66 can couple the tabs 56 and 58 to an adjacent fence post 16 thereby securing the first polymer jacketed high tensile wire fencing 12 to the fence post 16. The fourth edge 54 of the plate 18 is shown in FIG. 1 to be positioned so that the tabs 56, 58 straddle a second polymer jacketed high tensile wire fencing 14 to secure the second fencing 14 to an adjacent fence post 16. In this manner, the first embodiment of the terminator bracket assembly 10 is able to connect two separate lengths of the polymer jacketed high tensile wire fencing 12 and 14 to a common fence post 16.

Figure 3:
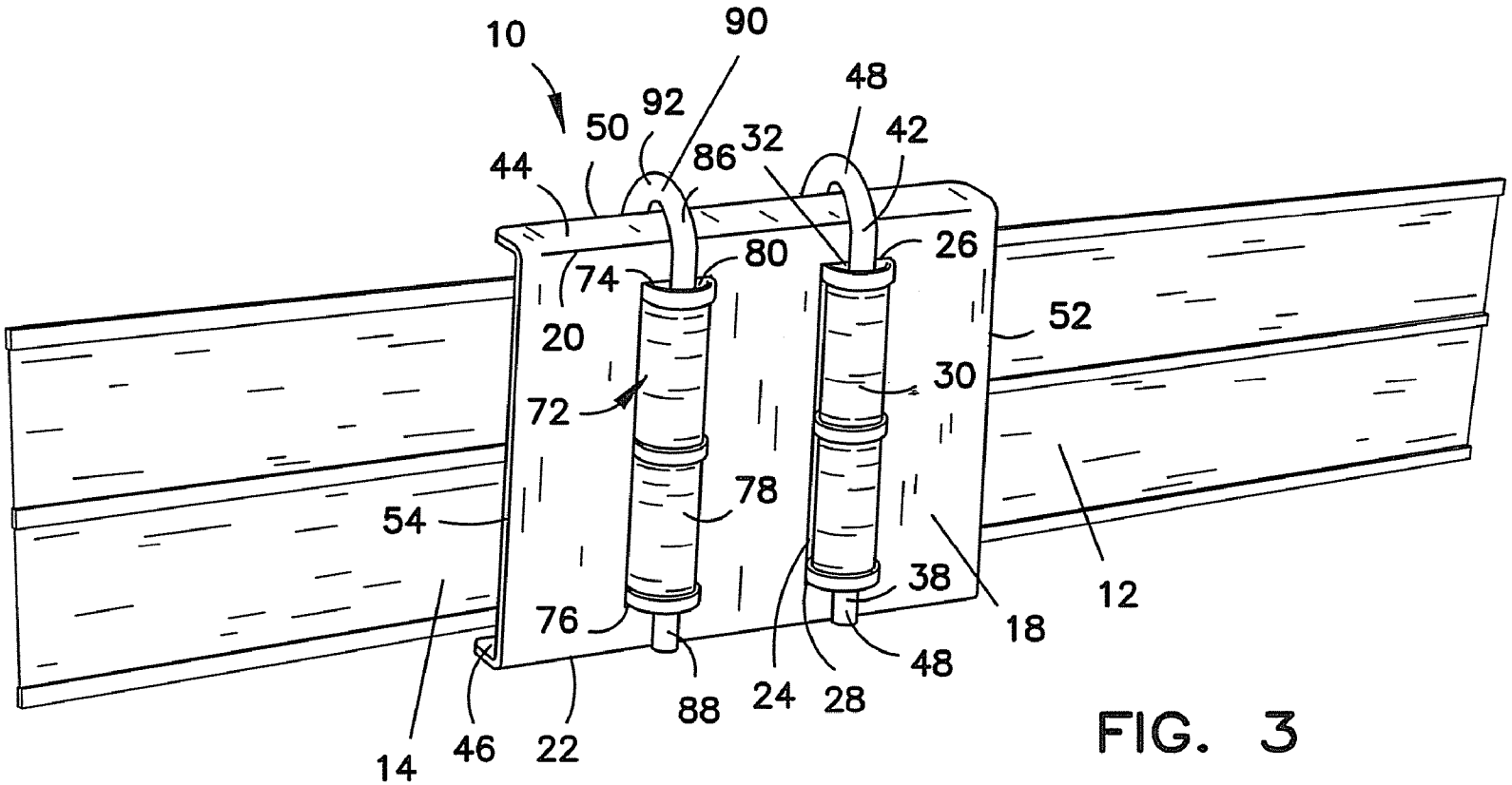
FIG. 3 is a perspective view of a second embodiment of the terminator bracket assembly coupled to the ends of both a first and second length of polymer jacketed high tensile wire fencing in a manner to splice the two ends together.
Figure 4:
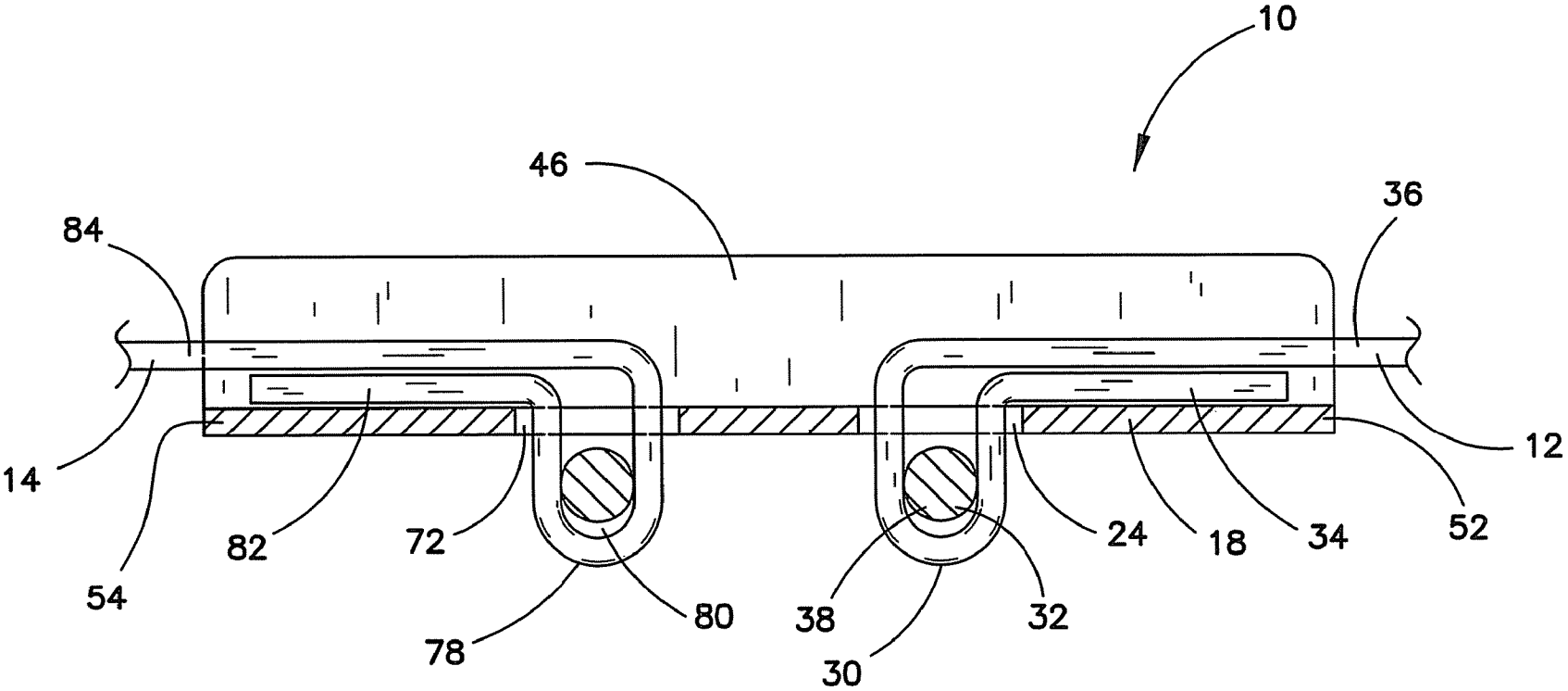
FIG. 4 is a sectional view of the bracket assembly shown in FIG. 3 showing the position of both of the shorter portions of the two lengths of fencing within the bracket.

A second embodiment of a terminator bracket assembly 10 is shown in FIGS. 3 and 4. FIG. 3 is a perspective view of the second embodiment of the terminator bracket assembly 10 coupled to ends of both a first length of polymer jacketed high tensile wire fencing 12 and a second length of polymer jacketed high tensile wire fencing 14 in a manner to splice the two ends together. The terminator bracket assembly 10 is shown in FIGS. 3 and 4 to include a plate 18 having a first edge 20 and a second edge 22. The first and second edges 20, 22 are shown to be generally parallel to each other. A first slot 24 passes through the plate 18 generally perpendicular to the first and second edges 20, 22. The slot 24 has an upper end 26 and a lower end 28 that are spaced from the first and second edges 20, 22, respectively. The first length of polymer jacketed high tensile wire fencing 12 includes a fold 30 that is arranged to define a bight 32 joining a shorter portion 34 of the fencing 12 to a longer portion 36 of the fencing 12. The fold 30 is shown to be positioned to penetrate the first slot 24 of the plate 18. The shorter portion 34 of the fencing 12 is shown in FIG. 4 to lie against a surface of the plate 18.

In the second embodiment, the plate 18 has a third edge 52 extending between the first and second edges 20, 22 and generally parallel to the first slot 24. The plate 18 also has a fourth edge 54 opposite the third edge 52. The fourth edge 54 is shown to be generally parallel to the third edge 52. In the second embodiment, a second slot 72 passes through the plate 18 adjacent to the first slot 24 and generally perpendicular to the first and second edges 20, 22. The second slot 72 has an upper end 74 and a lower end 76 that are spaced from the first and second edges 20, 22, respectively. The second length of polymer jacketed high tensile wire fencing 14 includes a fold 78 that is arranged to define a bight 80 joining a shorter portion 82 of the fencing 14 to a longer portion 84 of the fencing 14. The fold 78 is shown to penetrate the second slot 72 of the plate 18. The shorter portion 82 of the fencing 14 is shown in FIG. 4 to lie against the inner surface of the plate 18.

The first pin 38 shown in FIG. 3 has a lower end 40 and an upper end 42 separated from each other such that the pin 38 has a length which is greater than the distance between the upper end 26 and the lower end 28 of the slot 24. The pin 38 is shown to be inserted into the bight 32 in the fold 30 of the fencing 12. The upper end 42 of the pin 38 is shown to engage the first edge 20 of the plate 18 to retain the fold 30 of the fencing 12 in the slot 24. A second pin 86 is provided that has a lower end 88 inserted into the bight 80 in the fold 78 of the second fencing 14. The second pin 86 is shown to have an upper end 90 engaging the first edge 20 of the plate 18 to retain the fold 78 of the second fencing 14 in the second slot 72. The first and second edges 20 and 22 of the plate 18 are shown to include a rearwardly projecting flange 44, and 46, respectively. The upper end 42 of the first pin 38 is shown to include a bend 48 of sufficient size to extend over a rear edge 50 of the rearwardly projecting flange 44 of the first edge 20 while the opposite end contacts the plate surface adjacent to the lower edge 22 and the pin 38 is engaged in the bight 32. The upper end 90 of the second pin 86 is shown to include a bend 92 of sufficient size to extend over a rear edge 50 of the rearwardly projecting flange 44 of the first edge 20 while the opposite end 88 contacts the plate surface adjacent to the lower edge 22. The lower end 88 of the second pin 86, like the lower end 40 of the first pin 38 is dimensioned such that the second pin 86 can be removed vertically from the bight 80 to quickly release the fencing 14 from the second slot 72.

Figure 5:
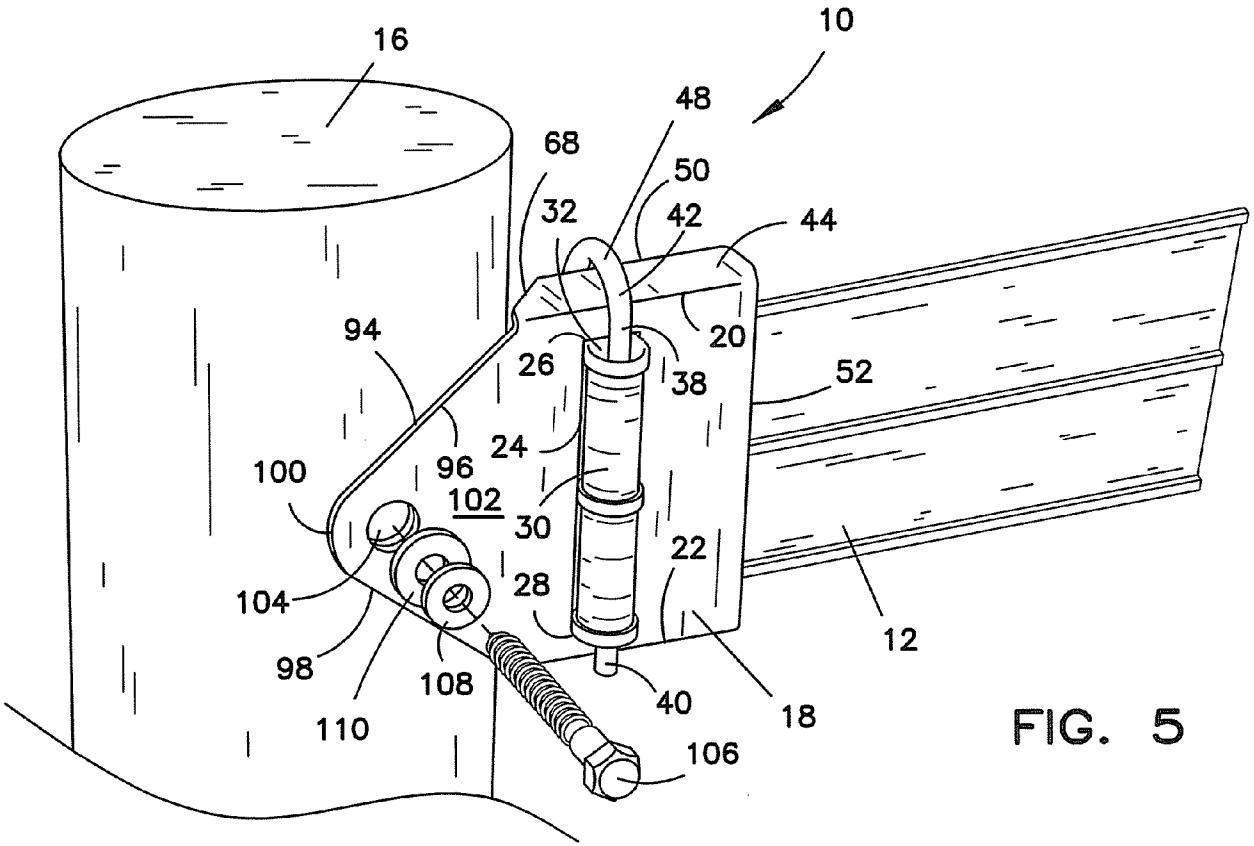
FIG. 5 is a perspective view of a third embodiment of the terminator bracket assembly coupled to an end of a first length of polymer jacketed high tensile wire fencing, the bracket assembly being secured to an adjacent fence post.
Figure 6:
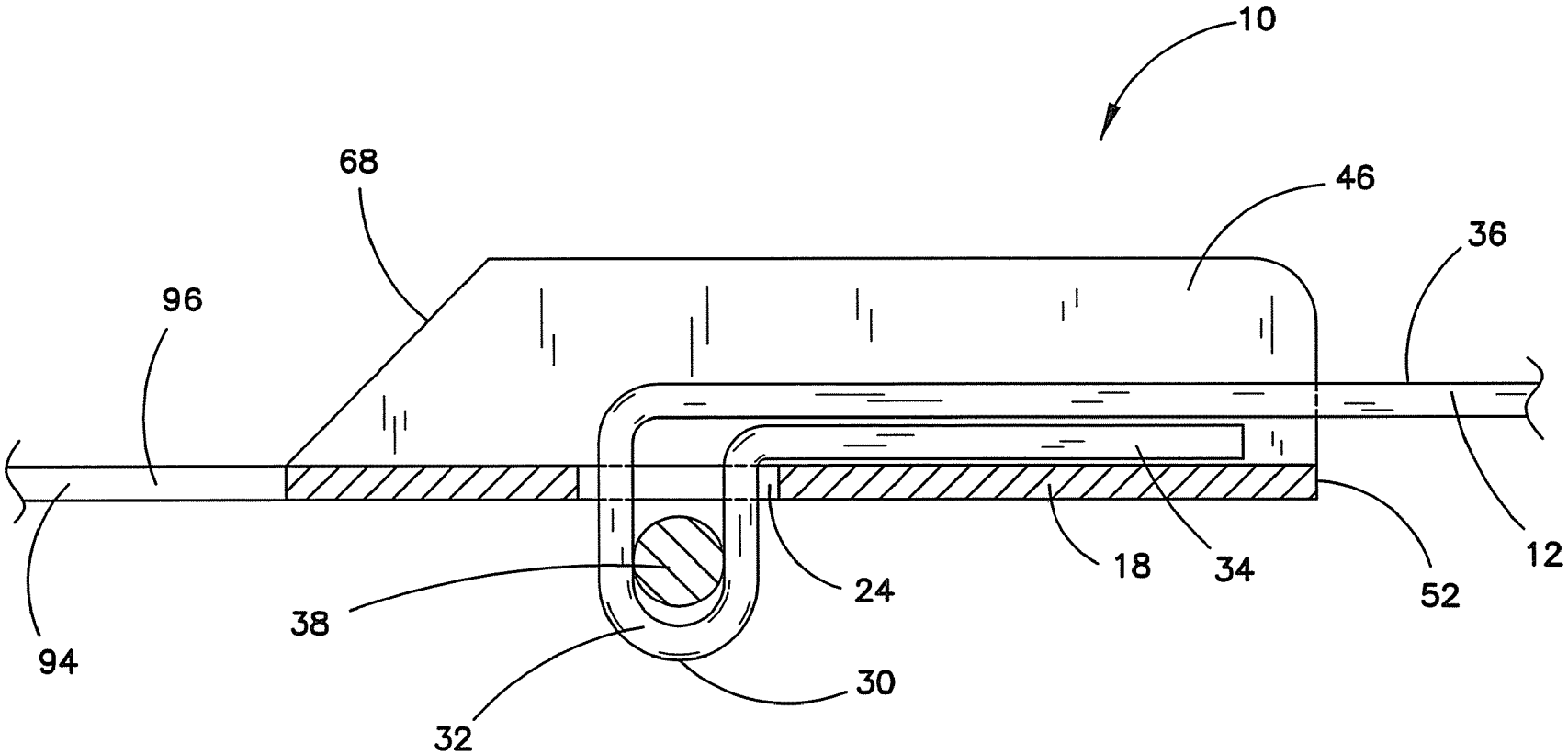
FIG. 6 is a sectional view of the bracket assembly shown in FIG. 5 showing the position of the shorter portion of the fencing within the bracket.
Figure 7:
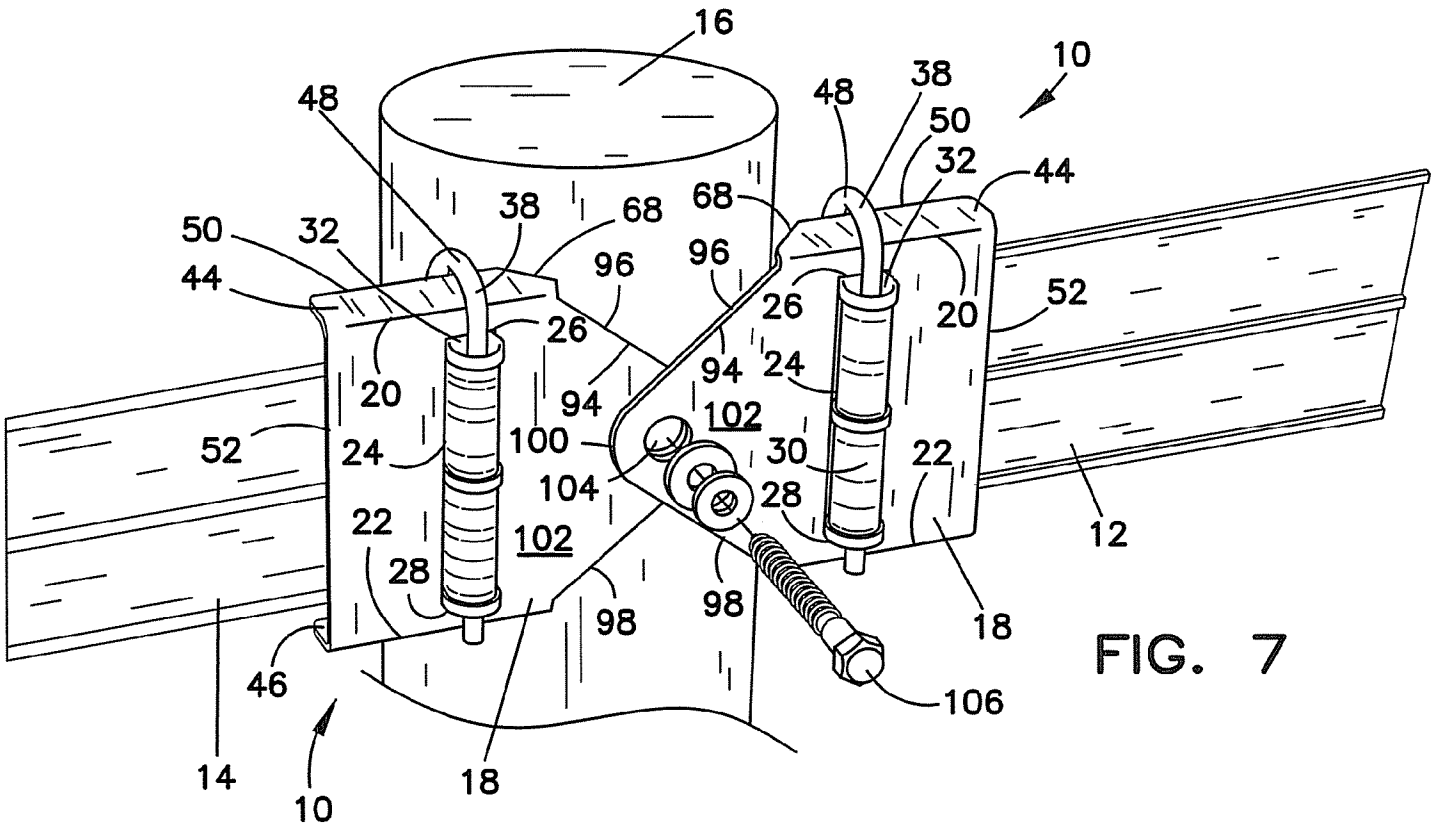
FIG. 7 is a perspective view showing the use of two of the third embodiments to secure two lengths of polymer jacketed high tensile wire fencing to a common fence post.
Figure 8:
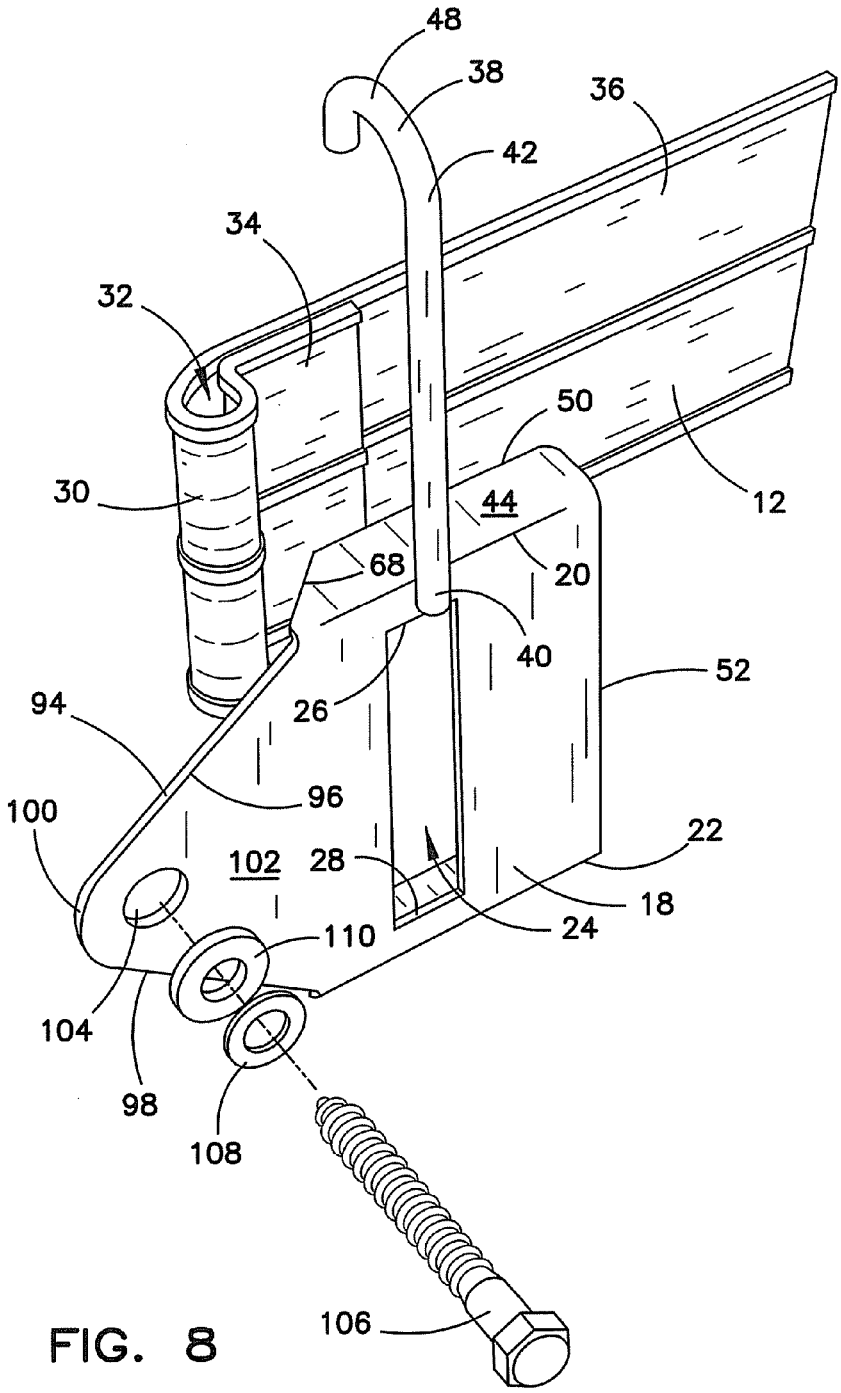
FIG. 8 is an exploded perspective view corresponding generally to FIG. 5.

FIGS. 5-8 show a third embodiment of a terminator bracket assembly 10. FIG. 5 is a perspective view of a single terminator bracket assembly 10, while FIG. 6 is a sectional view of the same terminator bracket assembly 10. FIG. 7 is a perspective view showing the use of two of the third embodiments to secure two lengths of polymer jacketed high tensile wire fencing 12 and 14 to a common fence post 16. FIG. 8 is an exploded view similar to FIG. 5. The terminator bracket assembly 10 of the third embodiment is shown to include a plate 18 having a first edge 20 and a second edge 22. The first and second edges 20, 22 are shown to be generally parallel to each other. A slot 24 passes through the plate 18 generally perpendicular to the first and second edges 20, 22. The slot 24 has an upper end 26 and a lower end 28 that are spaced from the first and second edges 20, 22, respectively. The first length of polymer jacketed high tensile wire fencing 12 includes a fold 30 that is arranged to define a bight 32 joining a shorter portion 34 of the fencing 12 to a longer portion 36 of the fencing 12. The fold 30 is shown to be positioned to penetrate the slot 24 of the plate 18. The shorter portion 34 of the fencing 12 is shown in FIG. 6 to lie against a surface of the plate 18.

The third embodiment of a terminator bracket assembly 10 includes a pin 38 has a lower end 40 and an upper end 42 separated from each other such that the pin 38 has a length which is greater than the distance between the upper end 26 and the lower end 28 of the slot 24. In FIGS. 5-7, the pin 38 is shown to be inserted into the bight 32 in the fold 30 of the fencing 12. The upper end 42 of the pin 38 is shown to engage the first edge 20 of the plate 18 to retain the fold 30 of the fencing 12 in the slot 24. The first and second edges 20, 22 of the plate 18 are shown to include a rearwardly projecting flange 44, and 46, respectively. The upper end 42 of the pin 38 is shown to include a bend 48 of sufficient size to extend over a rear edge 50 of the rearwardly projecting flange 44 of the first edge 20 while the opposite end contacts the plate surface adjacent to the lower edge 22 and the pin 38 is engaged in the bight 32. The pin 38, and particularly the lower end 40 of the pin 38, is dimensioned such that the pin 38 can be removed vertically from the bight 32 to quickly release the fencing 12 from the slot 24 as shown in FIG. 8.

In the third embodiment of a terminator bracket assembly 10, the plate 18 can include a third edge 52 extending between the first and second edges 20, 22 generally parallel to the slot 24. The plate 18 also includes a fourth edge 94 opposite the third edge 52. The fourth edge 94 is shown in FIGS. 5, 7 and 8 to include two oblique edges 96 and 98 joined by a curve 100 that combine to define a laterally projecting tongue 102. The tongue 102 is shown to include an opening 104 to receive a fastener 106. The fastener 106 can penetrate the tongue 102 to secure the plate 18 to a fence post 16. The fastener 106 can take the form of a lag screw that can pass through the opening 104 as well as washer 108 and grommet 110. As shown in FIG. 7, similar terminator bracket assemblies 10 having tongues 102 can secure two separate lengths of fencing 12, 14 to a single fence post 16 using the same single fastener 106. The rearwardly projecting flanges 44 and 46 can include a tapered edge 68 adjacent the projecting tongue 102 to facilitate the connection of the plate 18 to the adjacent fence post 16.

While FIG. 8 is an exploded perspective view of the third embodiment, it will be appreciated that a similar movement of the pin 38 vertically out of the bight 32 of any of the embodiments will lead to a quick release the fencing 12 from the slot 24. The pin 38 is shown to have a lower end 40 and an upper end 42 separated from each other such that the pin 38 has a length which is greater than the distance between the upper end 26 and the lower end 28 of the slot 24. The pin 38 is illustrated in FIG. 8 to have a "candy-cane" shape with the upper end 42 shown to include a bend 48 of sufficient size to extend over and engage the rear edge 50 of the rearwardly projecting flange 44 of the first edge 20. The pin 38 can have other shapes and appearances so long as there is some engaging feature between the pin 38 and the plate 18 to retain the fold 30 of the fencing 12 in the slot 24.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. An assembly comprising a length of polymer jacketed high tensile wire fencing having an end and a coupling coupled to the end of the extruded fencing, wherein the coupling includes a plate having first and second edges that are generally parallel to each other, the first and second edges of the plate including a rearwardly projecting flange, a slot passing through the plate generally perpendicular to the first and second edges, the slot having upper and lower ends spaced from the first and second edges, wherein the polymer jacketed high tensile wire fencing includes a fold in the fencing defining a bight joining a shorter portion of the fencing to a longer portion of the fencing, the fold penetrating the slot of the coupling, and wherein the coupling additionally includes a pin of a length greater than the distance between the upper and lower ends of the slot, the pin having a first end including a bend of sufficient size to extend over a rear edge of the rearwardly projecting flange of one of the first and second edges, the pin having a second end inserted into the bight in the fold of the fencing to retain the fold of the fencing in the slot.

2. The assembly of claim 1, wherein the plate includes a third edge extending between the first and second edges generally parallel to the slot and a fourth edge opposite the third edge.

3. The assembly of claim 2, wherein the fourth edge is generally parallel to the third edge.

4. The assembly of claim 3, wherein each of the first and second edges includes a tab extending outward in general alignment with the fourth edge of the plate, each tab including an opening to receive a fastener.

5. The assembly of claim 3, wherein the plate includes a second slot parallel to the first slot to receive a fold of a second polymer jacketed high tensile wire fencing defining a bight joining a shorter portion of the second fencing to a longer portion of the second fencing, the fold of the second fencing penetrating the second slot of the coupling, and a second pin having a first end engaging one of the first and second edges of the plate, the second pin having a second end inserted into the bight in the fold of the second fencing to retain the fold of the second fencing in the second slot.

6. The assembly of claim 2, wherein the fourth edge of the plate defines a laterally projecting tongue including at least one opening to receive a fastener.

7. An assembly comprising a length of polymer jacketed high tensile wire fencing having an end and a coupling coupled to the end of the fencing, wherein the coupling includes a plate having first and second edges that are generally parallel to each other, the first and second edges of the plate including a rearwardly projecting flange, a slot passing through the plate generally perpendicular to the first and second edges, the slot having upper and lower ends spaced from the first and second edges, wherein the polymer jacketed high tensile wire fencing includes at least two longitudinally extending high-tensile strength core members, a solid polymeric sheath encasing each of the core members, and a solid polymeric webbing joining the sheaths of adjacent core members at a fixed uniform separation distance in a substantially parallel arrangement, a fold in the fencing defining a bight joining a shorter portion of the fencing to a longer portion of the fencing, the fold penetrating the slot of the coupling and the shorter portion of the fencing lying against a surface of the plate adjacent the slot, and wherein the coupling additionally includes a pin of a length greater than the distance between the upper and lower ends of the slot, the pin having a first end including a bend of sufficient size to extend over a rear edge of the rearwardly projecting flange of one of the first and second edges of the plate, the pin having a second end inserted into the bight in the fold of the fencing to retain the fold of the fencing in the slot, the pin being vertically removable from the bight to quickly release the fencing from the coupling.

8. The assembly of claim 7, wherein the plate includes a third edge extending between the first and second edges generally parallel to the slot and a fourth edge opposite the third edge.

9. The assembly of claim 8, wherein the fourth edge is generally parallel to the third edge, wherein each of rearwardly projecting flanges of the first and second edges terminates in general alignment with the fourth edge of the plate, and wherein each of the first and second edges includes a tab extending vertically outward in general alignment with the fourth edge of the plate, each tab including an opening to receive a fastener.

10. The assembly of claim 8, wherein the plate includes a second slot parallel to the first slot to receive a fold of a second polymer jacketed high tensile wire fencing defining a bight joining a shorter portion of the second fencing to a longer portion of the second fencing, the fold of the second fencing penetrating the second slot of the coupling, and a first end of the second pin including a bend of sufficient size to extend over a rear edge of the rearwardly projecting flange of one of the first and second edges, the second pin having a second end inserted into the bight in the fold of the second fencing to retain the fold of the second fencing in the second slot, the shorter portion of the second fencing lying against a surface of the plate adjacent the slot.

11. The assembly of claim 8, wherein the fourth edge of the plate defines a laterally projecting tongue including at least one opening to receive a fastener, the rearward projecting flanges including a tapered edge adjacent the fourth edge.

12. An assembly comprising a fence post, a length of polymer jacketed high tensile wire fencing having an end, and a coupling coupled to the end of the fencing and to the fence post, wherein the coupling includes a plate having first and second edges that are generally parallel to each other, the first and second edges of the plate including a rearwardly projecting flange, a slot passing through the plate generally perpendicular to the first and second edges, the slot having upper and lower ends spaced from the first and second edges, the plate also having third and fourth edges, at least one of the third and fourth edges being generally parallel to the slot, one of the third and fourth edges being coupled to the fence post, wherein the polymer jacketed high tensile wire fencing includes at least two longitudinally extending high-tensile strength core members, a solid polymeric sheath encasing each of the core members, and a solid polymeric webbing joining the sheaths of adjacent core members at a fixed uniform separation distance in a substantially parallel arrangement, a fold in the fencing defining a bight joining a shorter portion of the fencing to a longer portion of the fencing, the fold penetrating the slot of the coupling and the shorter portion of the fencing lying against a surface of the plate adjacent the slot, and wherein the coupling additionally includes a pin of a length greater than the distance between the upper and lower ends of the slot, the pin having a first end including a bend of sufficient size to extend over a rear edge of the rearwardly projecting flange of one of the first and second edges of the plate, the pin having a second end inserted into the bight in the fold of the fencing to retain the fold of the fencing in the slot, the pin being vertically removable from the bight to quickly release the fencing from the coupling.

13. The assembly of claim 12, wherein the plate includes a third edge extending between the first and second edges generally parallel to the slot and a fourth edge opposite the third edge that defines a laterally projecting tongue including at least one opening, and a fastener passing through the opening in the tongue coupling the plate to the fence post.

14. The assembly of claim 12, further comprising a second polymer jacketed high tensile wire fencing passing the fence post, wherein the plate includes a third edge extending between the first and second edges generally parallel to the slot and a fourth edge opposite and parallel to the third edge, wherein each of the first and second edges includes a tab extending outward in general alignment with the fourth edge of the plate to straddle the second fencing, each tab including an opening to receive a fastener fixing the plate and the second fencing to the fence post.

15. The assembly of claim 12, wherein the longer portion of the fencing further comprises a second end and a second fold adjacent the second end defining a second bight joining the longer portion of the fencing to a second shorter portion of the fencing, the assembly further comprising a second pin and a second plate, the second plate having first and second edges that are generally parallel to each other, a slot passing through the second plate generally perpendicular to the first and second edges of the second plate, the second plate slot having upper and lower ends spaced from the first and second edges of the second plate, the second fold penetrating the slot of the second plate and the second shorter portion of the fencing lying against a surface of the second plate adjacent the second slot, the second pin including an end inserted into the bight in the second fold of the fencing to retain the second fold in the second slot.

16. The assembly of claim 15, wherein the second plate includes a third edge extending between the first and second edges of the second plate generally parallel to the second slot and a fourth edge opposite the third edge of the second plate, and wherein each of the first and second edges of the second plate includes a rearwardly projecting flange, an upper end of the second pin including a bend of sufficient size to extend over a rear edge of the rearwardly projecting flange of one of the first and second edges of the second plate.

17. The assembly of claim 16, wherein the fourth edge of the second plate is generally parallel to the third edge, wherein each of rearwardly projecting flanges of the first and second edges of the second plate terminates in general alignment with the fourth edge of the second plate, and wherein each of the first and second edges of the second plate includes a tab extending vertically outward in general alignment with the fourth edge of the second plate, each tab including an opening to receive a fastener.

18. The assembly of claim 16, wherein the second plate includes a second slot parallel to the first slot of the second plate to receive a fold of a second polymer jacketed high tensile wire fencing defining a bight joining a shorter portion of the second fencing to a longer portion of the second fencing, the fold of the second fencing penetrating the second slot of the second plate, and a first end of the second pin including a bend of sufficient size to extend over a rear edge of the rearwardly projecting flange of one of the first and second edges of the second plate, and further comprising a third pin having an end inserted into the bight in the fold of the second fencing to retain the fold of the second fencing in the second slot, the shorter portion of the second fencing lying against a surface of the plate adjacent the slot.

19. The assembly of claim 16, wherein the fourth edge of the second plate defines a laterally projecting tongue including at least one opening to receive an additional fastener, the rearward projecting flanges of the second plate including a tapered edge adjacent the fourth edge of the second plate.

* * * * *